United States Patent [19]

Rassieur

[11] 4,345,493

[45] Aug. 24, 1982

[54] DRILL ROD HOLDING AND BREAK-OUT DEVICE

[75] Inventor: Charles L. Rassieur, Creve Coeur, Mo.

[73] Assignee: Central Mine Equipment Company, St. Louis, Mo.

[21] Appl. No.: 199,428

[22] Filed: Oct. 22, 1980

[51] Int. Cl.[3] ..... B25B 13/50

[52] U.S. Cl. ..... 81/57.34; 81/57.41

[58] Field of Search ..... 81/57.33, 57.34, 57.35, 81/57.4, 57.41, 57.16, 57.24, 57.25

[56] References Cited

U.S. PATENT DOCUMENTS

| | | | |
|---|---|---|---|
| 1,736,009 | 11/1929 | Nixon | 81/57.34 |
| 3,500,708 | 3/1970 | Wilson | 81/57.35 |
| 3,844,547 | 10/1974 | Lang et al. | 81/57.34 |
| 4,030,542 | 6/1977 | Poe et al. | 81/57.35 |
| 4,194,419 | 3/1980 | Mitchhart et al. | 81/57.35 |

*Primary Examiner*—James L. Jones, Jr.

*Attorney, Agent, or Firm*—Polster, Polster & Lucchesi

[57] ABSTRACT

A vehicle mounted drill rod holding and break-out device has a clamp jaw support reciprocatingly mounted in a housing. The housing is pivotally mounted on the vehicle to permit the free end of the housing, hence the clamp jaw support, to swing toward and away from the vehicle. A selectively extensible and retractable arm is pivotally mounted at one end on the outside of the housing. At its free end, the arm carries a pipe wrench, pivotally mounted on the arm in such a way that when the jaws of the pipe wrench engage a drill rod at the extended position of the arm and the arm is retracted, the drill rod is rotated to break a joint between the clamp and the wrench. The height of the housing is made adjustable to accommodate travel and working conditions.

8 Claims, 4 Drawing Figures

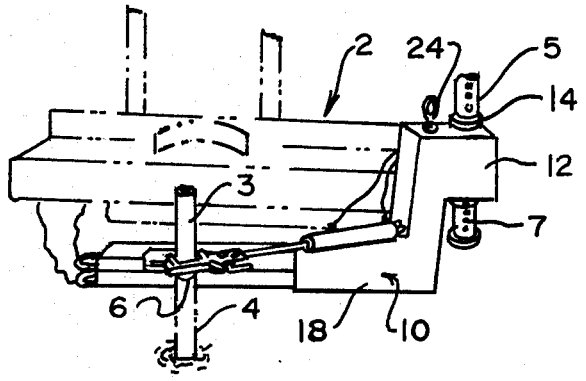
FIG. 1.
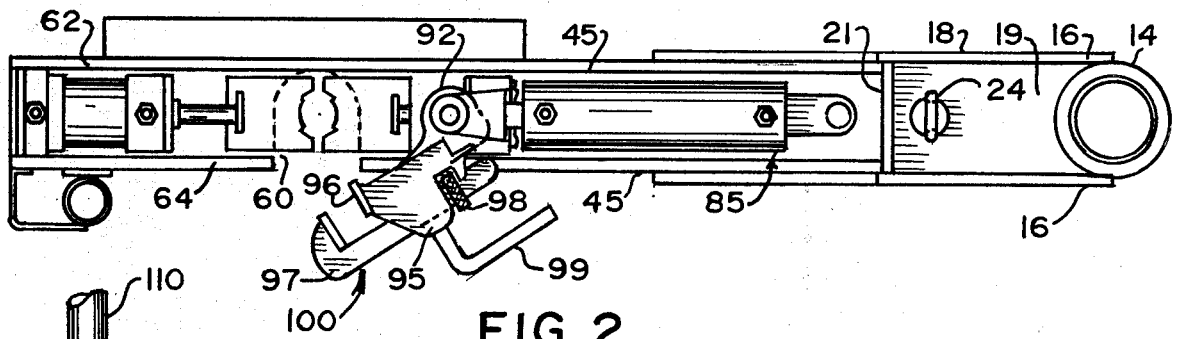
FIG. 2.
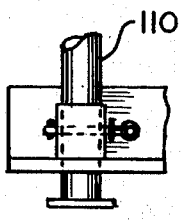
FIG. 3.
FIG. 4.
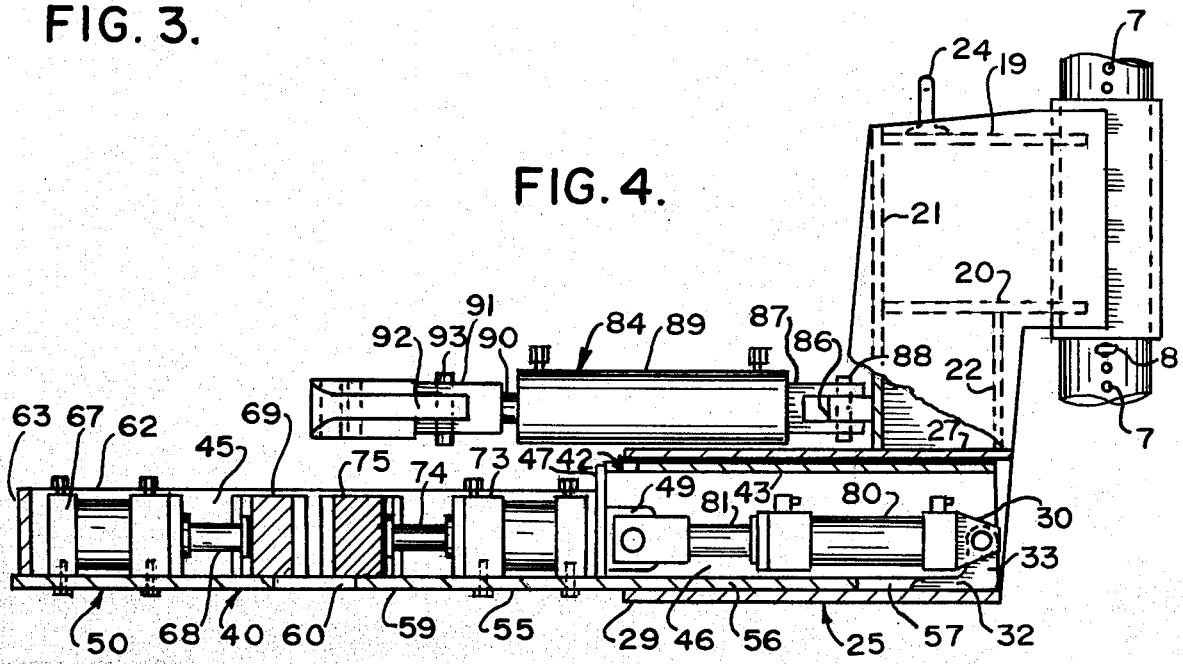

DRILL ROD HOLDING AND BREAK-OUT DEVICE

BACKGROUND OF THE INVENTION

This invention relates to vehicle mounted devices for holding drill rods when they are raised or lowered in a drill hole, and for unthreading and disconnecting drill rod sections. Typically drill rods are furnished in ten foot lengths. There may be several hundred feet of drill rods in a hole. When coming out of the hole, the rods need to be disconnected in ten or twenty foot lengths. In the past, a rod holder has been secured to the back end of a vehicle. The rod holder usually has had a pair of clamp jaws with cam surfaces that are positioned to grip the rod that is being driven by driving mechanism mounted on the vehicle. The jaws are removed during the drilling, and then are installed in a receiver to clamp the drill rod between them. The jaws prevent the rod from moving axially and tend to inhibit it from turning. In practice, when drilling a hole, the drill rods are likely to shift slightly due to movement of the vehicle. Conventional clamps are not equipped to cope with this problem. Also, it is frequently difficult to break-out sections of rods that are threaded together. The drill string is clamped by the jaws immediately below a joint, and the joint is commonly broken manually, with pipe wrenches.

One of the objects of this invention is to provide a rod holding device that is simple and at the same time provides ready adjustment to accommodate misalignment of the vehicle and drill string.

Another object is to provide a rod holding device that hydraulically clamps drill rods with two opposing hydraulic cylinders.

Another object is to provide a rod holding device that is pivotally mounted and will swing on and off the drill hole.

Another object is to provide such a device that can be moved vertically to adjust its height for ease in transporting and convenience of use.

Another object is to provide such a rod holding device with a break-out device that is simple and rugged and that is power actuated to break the joint of a drill string.

Other objects will occur to those skilled in the art in light of the following description and accompanying drawings.

SUMMARY OF THE INVENTION

In accordance with this invention, generally stated, a vehicle mounted drill rod holding and break-out device has a clamp jaw support reciprocatingly mounted in a housing. The housing is pivotally mounted on the vehicle to permit the free end of the housing, hence the clamp jaw support, to swing toward and away from the vehicle. A selectively extensible and retractable arm is pivotally mounted at one end on the outside of the housing. At its free end, the arm carries a pipe wrench, pivotally mounted on the arm in such a way that when the jaws of the pipe wrench engage a drill rod at the extended position of the arm and the arm is retracted, the drill rod is rotated in a direction to break a joint between the clamp and the wrench. The housing is also preferably mounted to permit its being raised and lowered vertically.

BRIEF DESCRIPTION OF THE DRAWINGS

In the drawing,

FIG. 1 is a view in perspective of one illustrative embodiment of rod holding and break-out device of this invention;

FIG. 2 is a top plan view of the device shown in FIG. 1;

FIG. 3 is a fragmentary detailed view in front elevation of a jack leg element of the device of FIG. 2; and FIG. 4 is a view in front elevation, partly broken away and partly in section of the device shown in FIG. 2.

DESCRIPTION OF THE PREFERRED EMBODIMENT

Referring now to the drawing for one illustrative embodiment of rod holding and break-out device of this invention, reference numeral 1 indicates the device mounted on a vehicle 2 that also carries a rotary drilling rig, for example of the type described in U.S. Pat. No. 3,527,309.

A drill string with an upper rod section 3 and a lower rod section 4 is shown as clamped preparatory to breaking a joint 6, as will be described hereinafter.

The device 1 in this embodiment is mounted on a post 5. The post 5 is securely mounted to the vehicle by means of a bracket, not here shown, that holds the post 5 vertically and spaced along its length sufficiently from the vehicle to permit swinging of the device 1. The post 5 has diametric holes 7 in it, spaced along its length, through which a pin 8 extends to hold the device at any desired axial height along the post 5. The post is circular in cross-section and the device 1 is mounted for sliding and swinging movement on it.

The device 1 includes a housing 10 which in this embodiment includes a dog-leg bracket 12 to which a sleeve 14 is secured, and a tube 25. The housing 10 is made of heavy steel, for example ½" plate, with side plates 18, between wings 16 of which the sleeve 14 is welded, a top plate 19 to which a lifting eye 24 is secured, an internal reinforcing plate 20, a front plate 21, a back plate 22, a top tube wall 27, and a bottom tube wall 29. The tube 25 is rectangular in transverse cross-section, and open-ended. The side walls of the tube 25 are integral with and of a piece with the side plates 18.

A hydraulic cylinder mount bracket 30 has a foot 32 welded to the inside surface of the bottom wall 29, and an upstanding leaf 33.

A clamp support 40 has a tubular section 42 that telescopes within the tube 25, as best shown in FIG. 4, and a clamp platform section 50. The tubular section 42 is made up of a top wall 43, a housing section 46 of side walls 45, a housing section 56 of a bottom wall 55 and a front wall 47. A pair of yoke plates 49 spaced from one another, are welded to the inside surface of the front wall 47. A slot 57 in the housing section of the bottom wall, opening through the free end edge, accommodates the foot 32 of the hydraulic cylinder bracket 30.

The clamp platform section 50 is made up of a platform section 59 of the bottom wall 55, integral with and of a piece with the bottom wall housing section 56, with a rod clearance opening 60, an uninterrupted back platform section 62 of a side wall 45, a front platform section 64 of the other side wall 45, interrupted to clear the mouth of opening 60, and an outer end wall 63. As seen in FIG. 2, the platform section 59 is widened through part of its length to provide strength through the area around the opening 60.

A far hydraulic cylinder 67 is bolted to the bottom wall section 59 near the outer end wall 63. A piston rod 68 projecting from the cylinder 67 is connected to a far clamping jaw 69. A near hydraulic cylinder 73 is bolted to the platform section 59 of the bottom wall 55 near the front wall 47. A piston rod 74 projecting from the cylinder 73 is connected to a near clamping jaw 75, which faces the far clamping jaw 69 across the opening 60.

A clamp support hydraulic cylinder 80 is pivotally mounted at one end to the leaf 33. A piston rod 81 projecting from the cylinder 80, is pivotally mounted at its outer end to the yoke plates 49.

A break-out assembly 84 includes an extensible and retractable arm 85, swingably mounted on a horizontal leaf 86 welded at one end to the outside surface of the front plate 21 of the housing 10. The arm 85, in this embodiment is made up of a hydraulic cylinder 89, swingably mounted on the leaf 86 by means of a clevis 87 and clevis pin 88, and a piston rod 90 projecting from the cylinder 89 in a direction toward the opening 60. The piston rod 90 has a knuckle 91 at its outer end to which a hinge plate 92 is hingedly mounted by means of a hinge pin 93. The hinge plate 92 is secured, as by welding, to a housing 95 of a pipe wrench 100. Except for the lack of a conventional handle and its replacement with an L-shaped handle 99, a stem of which is welded to the housing to project at substantially right angles to the usual handle, as shown in FIG. 2, the pipe wrench 100 is conventional, with a fixed jaw 96 mounted on the housing 95, a hook jaw 97, and a knurled adjusting nut 98.

The device is usually carried in its uppermost position on the post 5 when the vehicle on which it is mounted is moving from place to place, and swung toward the vehicle until its outer end either engages the vehicle or a stop, where it is chained or otherwise secured for traveling. It is lowered by a hoist, by means of the eye 24, to a convenient working height, and a pin 8, which was removed to permit its being lowered, is replaced in the appropriate hole to hold the device at the desired working level. It is understood that flexible hydraulic lines are connected to fittings on the hydraulic cylinders 67, 73, 80 and 89 and to a suitable source of hydraulic fluid under pressure, by way of controls by which fluid can be admitted selectively to one end or the other of each of the cylinders individually. This is conventional. In operation, the housing 10 is positioned vertically at the desired height. It is generally kept in its uppermost position during travel to the work site and lowered when the rig is in place. The housing 10, hence the clamp support 40 and break-out assembly 84 initially can be swung out of the way, toward the vehicle. When it is desired to clamp a drill string, the housing and clamp support are swung toward the drill string and the clamp platform moved in a direction toward or away from the tube of the housing, by means of the cylinder 80, until the opening 60 is properly centered. A jack leg 110 can be dropped into engagement with the ground, and tightened to support the outer end of the clamp support. The jaws 69 and 75 are moved toward one another to clamp the drill string tightly between them. If a section is to be broken out, the arm 85 is swung out away from the vehicle and away from the clamp platform, and extended until the jaw 96 is well beyond the axis of the drill string. The pipe wrench 100 is swung to an angle with respect to the arm 85 opposite to that shown in FIG. 2 and the section to be broken out is gripped between the jaws 96 and 97. The arm is then retracted, by moving the piston rod 90 hydraulically in the direction toward the leaf 86, to twist the section to be broken out with respect to the lower section that is clamped fixedly between the jaws 69 and 75.

Numerous variations in the construction of the device of this invention, within the scope of the appended claims, will occur to those skilled in the art in the light of the foregoing disclosure. Merely by way of illustration, the dog leg bracket 12 can be made of different configuration and with different arrangements of plates and strengthening members, although the configuration and construction of the housing 10 illustrated and described have proven to be advantageous. The particular means for actuating the clamp jaws and the arm 85 can be varied, although the hydraulic cylinder arrangement illustrated and described is simple, rugged and dependable. Because the clamp support is moved in and out with respect to the housing, one of the clamp jaws can be fixed, and moved into engagement with one side of a drill string, and the other clamp jaw moved by its hydraulic cylinder or the like into engagement with the other side of the drill string. The pivotal arrangement and heightwise adjustment of the device and advantageous features, even if the conventional wedge type clamp jaws are used. These are merely illustrative.

I claim:

1. In a vehicle mounted rod holding and break-out device the improvement comprising a clamp support, a pair of oppositely disposed clamp jaws mounted on said support, means mounted on said support for moving at least one of said clamp jaws toward and away from the other, a housing for mounting and supporting one end of said clamp support for sliding in and out with respect to said housing, means mounted in said housing and connected to said support for moving said support in and out directions, and means mounted on said vehicle for pivotally supporting said housing for swinging said housing and support toward and away from said vehicle.

2. The improvement of claim 1 including a selectively extensible and retractable arm, pivotally mounted at one end on the outside of said housing, a pipe wrench housing pivotally mounted on a free end of said arm, a jaw adjustably mounted in said pipe wrench housing, and means for selectively extending and retracting said arm.

3. The improvement of claim 1 wherein the means for moving at least one of the oppositely disposed clamp jaws and for moving said clamp support are hydraulic cylinders.

4. The improvement of claim 1 wherein the housing includes a tube, rectangular in transverse cross-section, the end of the clamp support mounted in said housing is a complementarily shaped tube telescopically mounted in said housing tube and the means for moving the clamp support is a hydraulic cylinder mounted to said housing at one end and extending within said clamp support end tube.

5. The improvement of claim 1 wherein the housing includes a dog-leg bracket with a sleeve, and the mounting means includes a post journaled in said sleeve and fixedly mounted on said vehicle, said post being substantially longer than said sleeve, whereby said sleeve, hence said housing, can be moved up and down on said post to vary the height of the housing from the ground, and means for holding said sleeve in a desired position while permitting swinging movement of said sleeve around said post.

6. The improvement of claim 2 wherein the said arm comprises a hydraulic cylinder and piston.

7. In a vehicle mounted rod holding and break-out device the improvement comprising a clamp jaw support, a pair of oppositely disposed clamp jaws mounted on said support, means mounted on said support for moving at least one of said clamp jaws toward and away from the other, an arm carried by said support and pivotally mounted at one end for swinging movement with respect to said clamp jaw support, rod breaking means mounted on a free end of said arm, means for extending and retracting said arm, means mounted on said vehicle for mounting said support for pivotal and axial movement thereon, to permit swinging said support toward and away from said vehicle and for heightwise movement on said mounting means, and means for selectively maintaining said support at any one of a plurality of heights on said mounting means.

8. The improvement of claim 7 wherein both of said clamp jaws are mounted for movement toward and away from one another, and the means for moving said clamp jaws are hydraulic cylinders.

* * * * *

UNITED STATES PATENT AND TRADEMARK OFFICE

CERTIFICATE OF CORRECTION

PATENT NO. : 4,345,493

DATED : August 24, 1982

INVENTOR(S) : Charles L. Rassieur

It is certified that error appears in the above—identified patent and that said Letters Patent is hereby corrected as shown below:

Claim 1, line 9, after "moving said support in" insert ---in---.

Signed and Sealed this

Sixteenth Day of November 1982

[SEAL]

*Attest:*

GERALD J. MOSSINGHOFF

*Attesting Officer*

*Commissioner of Patents and Trademarks*